US012408805B2

(12) United States Patent
Hu et al.

(10) Patent No.: US 12,408,805 B2
(45) Date of Patent: Sep. 9, 2025

(54) DEBRIS BIN ASSEMBLY, CLEANING ROBOT AND SYSTEM THEREOF

(71) Applicant: SHENZHEN SILVER STAR INTELLIGENT GROUP CO., LTD, Shenzhen (CN)

(72) Inventors: Yi Hu, Shenzhen (CN); Xuehua Li, Shenzhen (CN); Xueling Li, Shenzhen (CN)

(73) Assignee: SHENZHEN SILVER STAR INTELLIGENT GROUP CO., LTD, Shenzhen (CN)

( * ) Notice: Subject to any disclaimer, the term of this patent is extended or adjusted under 35 U.S.C. 154(b) by 406 days.

(21) Appl. No.: 17/939,362

(22) Filed: Sep. 7, 2022

(65) Prior Publication Data

US 2023/0099702 A1 Mar. 30, 2023

(30) Foreign Application Priority Data

Sep. 30, 2021 (CN) ..... 202111165421.6

(51) Int. Cl.
*A47L 11/40* (2006.01)

(52) U.S. Cl.
CPC ..... *A47L 11/4027* (2013.01); *A47L 11/4072* (2013.01); *A47L 2201/00* (2013.01)

(58) Field of Classification Search
CPC .... A47L 9/1409; A47L 9/149; A47L 11/4027; A47L 2201/00; A47L 2201/024
See application file for complete search history.

(56) References Cited

U.S. PATENT DOCUMENTS 10,925,447 B2 * 2/2021 Der Marderosian ..... A47L 11/4094
12,004,704 B2 * 6/2024 Morin ..... A47L 9/281
(Continued)

FOREIGN PATENT DOCUMENTS

CN 208002731 U 10/2018
CN 211883655 U 11/2020
(Continued)

OTHER PUBLICATIONS

First Chinese Office Action for Chinese Application No. 202111165421.6 mailed Jul. 16, 2025. 14 pages.

*Primary Examiner* — Monica S Carter
*Assistant Examiner* — Sharonda T Felton
(74) *Attorney, Agent, or Firm* — Brooks Kushman P.C.

(57) ABSTRACT

The present application provides a debris bin assembly including: a debris bin housing and a debris discharge valve; the debris bin housing includes an inner cavity, and an air inlet, a debris outlet, and at least one air guide portion that are disposed in communication with the inner cavity, and the air inlet is in communication with a debris inlet channel of the cleaning robot; the debris discharge valve is disposed at the debris outlet and configured to open the debris outlet to evacuate debris from the inner cavity in response to a vacuum negative pressure, and to close the debris outlet after the vacuum negative pressure is withdrawn; the at least one air guide portion is configured for being in communication with an external air and configured to guide a debris discharging airflow into the inner cavity in response to the vacuum negative pressure in the debris outlet.

19 Claims, 5 Drawing Sheets

(56) References Cited

U.S. PATENT DOCUMENTS

| | | | | |
|---|---|---|---|---|
| 2007/0016328 | A1* | 1/2007 | Ziegler | B60R 19/483 318/609 |
| 2012/0291809 | A1* | 11/2012 | Kuhe | A47L 11/33 134/18 |
| 2016/0278596 | A1* | 9/2016 | Janzen | A47L 11/4066 |
| 2016/0327954 | A1 | 11/2016 | Hoshino | |

FOREIGN PATENT DOCUMENTS

| | | | |
|---|---|---|---|
| CN | 112869634 | A | 6/2021 |
| CN | 214208244 | U | 9/2021 |
| CN | 214259194 | U | 9/2021 |
| CN | 214259220 | U | 9/2021 |
| CN | 216417045 | U | 5/2022 |
| JP | 2003159202 | A | 6/2003 |
| WO | 2012149572 | A2 | 11/2012 |
| WO | 2016093911 | A1 | 6/2016 |

* cited by examiner

DEBRIS BIN ASSEMBLY, CLEANING ROBOT AND SYSTEM THEREOF

CROSS REFERENCE TO RELATED APPLICATION

Pursuant to 35 U.S.C. § 119 and the Paris Convention, the present application claims the benefit of Chinese Patent Application No. 202111165421.6 filed Sep. 30, 2021, the contents of which are incorporated herein by reference.

TECHNICAL FIELD

The present application relates to a field of cleaning robots, and more particularly to a debris bin assembly, a cleaning robot and a system thereof.

BACKGROUND

While the cleaning robot (for example, a sweeping robot) automatically moves on the floor, the cleaning robot can suck the dust and debris on the floor into the debris bin of the robot through the air inlet channel to clean the area where the robot passes. Robots are fully developed and widely configured for the convenience.

In order to avoid users from emptying debris bin frequently, a large-sized debris collector and a suction unit are added to the charging base in cooperation with the robot. When the cleaning robot returns to the charging base for charging, the suction unit sucks the debris from the debris bin of the robot into the debris collector of the charging base. This process is also called reverse vacuuming. At present, it is found that after reverse vacuuming, there is still a lot of debris left in the debris bin of the robot, and the debris discharging efficiency of the debris bin is lower.

SUMMARY

Embodiments of the present application provide a debris bin assembly, a cleaning robot and a system thereof, so as to solve the technical problem that the dust left in the debris bin is more, and the debris discharging efficiency of the debris bin is lower.

An embodiment of the present application provides a debris bin assembly, and the debris bin assembly is applied to a cleaning robot; the debris bin assembly includes: a debris bin housing and a debris discharge valve; the debris bin housing includes an inner cavity, an air inlet, a debris outlet, and at least one air guide portion; the air inlet, the debris outlet, and the air guide portion are disposed in communication with the inner cavity, and the air inlet is configured for being in communication with a debris inlet channel of the cleaning robot; the debris discharge valve is disposed at the debris outlet and configured to open the debris outlet to evacuate debris from the inner cavity in response to a vacuum negative pressure, and to close the debris outlet after the vacuum negative pressure is withdrawn; the at least one air guide portion is configured for being in communication with an external air and configured to guide a debris discharging airflow into the inner cavity in response to the vacuum negative pressure in the debris outlet.

An embodiment of the present application provides a cleaning robot, and the cleaning robot includes a robot body and the debris bin assembly above-mentioned, the debris bin assembly is detachably mounted on the robot body.

An embodiment of the present application further provides a cleaning robot system, and the cleaning robot system includes the cleaning robot above-mentioned and a cleaning base station; the cleaning base station is provided with a debris collection port configured to align with a debris outlet of the debris bin housing, and the cleaning base station sucks a debris in the inner cavity through the debris collection port and the debris outlet.

Compared with the prior art, in the above-mentioned debris bin assembly, the cleaning robot and the system thereof, the debris bin housing is provided with the inner cavity, the air inlet, the debris outlet, and the at least one air guide portion; and the air inlet is configured for being in communication with a debris inlet channel of the cleaning robot; the at least one air guide portion is configured for being in communication with an external air and configured for responding to the vacuum negative pressure in the debris outlet to introducing debris discharging airflow to the inner cavity, therefore, the air volume of the debris discharging airflow can be increased through the at least one air guide portion, and the debris discharging airflow can pass through the at least one air guide portion and the air inlet in different directions, which can increase the airflow at different positions inside the debris bin, and is beneficial to promote the residual debris in the inner cavity to be discharged through the debris outlet, thereby the debris evacuation efficiency of the debris bin assembly is improved and the problem of more debris remaining in the debris bin is solved.

BRIEF DESCRIPTION OF THE DRAWINGS

One or more embodiments are exemplified by the figures in the corresponding drawings, and these exemplifications do not constitute limitations of the embodiments, and elements with the same reference numerals in the drawings are denoted as similar elements, unless otherwise stated, the figures in the accompanying drawings do not constitute a scale limitation.

DETAILED DESCRIPTION OF EMBODIMENTS

Figure 1:
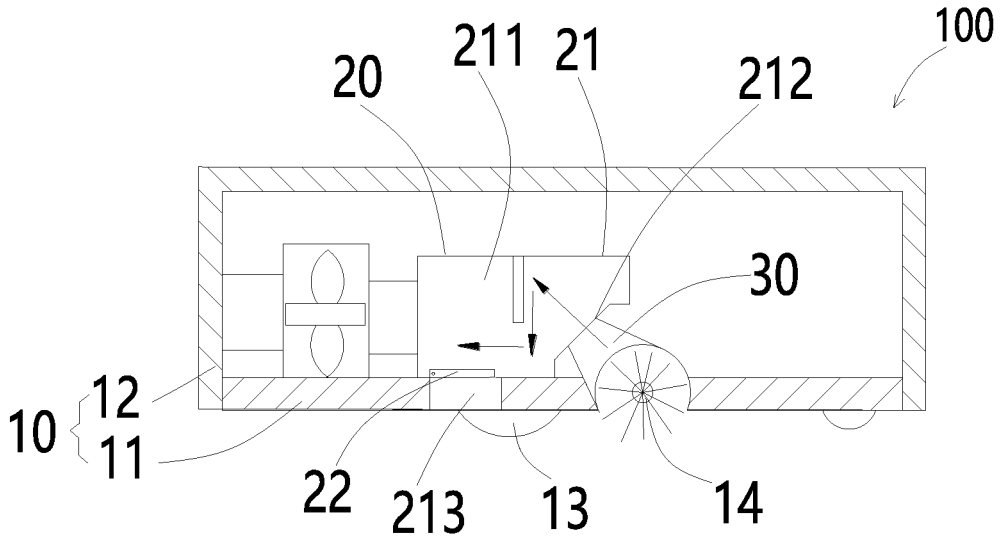
FIG. 1 is a schematic diagram of a longitudinal cross-sectional structure of a cleaning robot provided by an embodiment of the present application.

In order to make the objectives, technical solutions and advantages of the present application clearer, the present application will be further described in detail below with reference to the accompanying drawings and embodiments. It should be understood that the specific embodiments described herein are only used to explain the present application, but not to limit the present application. Based on the embodiments of the present application, all other embodiments obtained by those skilled in the art without creative efforts shall fall within the protection scope of the present application.

It should be noted that, if there is no conflict, various features in the embodiments of the present application may be combined with each other, which are all within the protection scope of the present application. In addition, although the functional modules are divided in the schematic view of the device, and the logical sequence is shown in the flowchart, in some cases, the modules in the device may be divided differently, or the sequence or the described steps shown in the flowchart may be performed. Furthermore, the words "first", "second" and "third" used in the present application do not limit the data and execution order, but only distinguish the same or similar items with basically the same function and effect.

Referring to FIG. 1 to FIG. 4, an embodiment of the present application provides a cleaning robot 100. The cleaning robot 100 includes a robot body 10 and a debris bin assembly 20 detachably connected to the robot body 10.

The debris bin assembly 20 includes a debris bin housing 21 and a debris discharge valve 22, the debris bin housing 21 is provided with an inner cavity 211, an air inlet 212, a debris outlet 213, and at least one air guide portion 214, the air inlet 212, the debris outlet 213 and the air guide portion 214 are arranged in communication with the inner cavity 211, the air inlet 212 is arranged in communication with the debris inlet channel 30 of the cleaning robot 100, and the debris discharge valve 22 is arranged at the debris outlet 213, the debris discharge valve 22 is used to open the debris outlet 213 in response to the negative vacuum pressure to discharge the debris in the inner cavity 211, and cover the debris outlet 213 after the negative vacuum pressure is withdrawn, the at least one air guide portion 214 is configured for being in communication with the external air, and the at least one air guide portion 214 is configured for introducing debris discharging airflow to the inner cavity 211 in response to the negative vacuum pressure at the debris outlet 213.

Compared with the prior art, in the above-mentioned debris bin assembly 20, the debris bin housing 21 is provided with the inner cavity 211, the air inlet 212, the debris outlet 213, and the at least one air guide portion 214; and the air inlet 212 is configured for being in communication with a debris inlet channel 30 of the cleaning robot 100; the at least one air guide portion 214 is configured for being in communication with an external air and configured for responding to the vacuum negative pressure in the debris outlet 213 to introducing debris discharging airflow to the inner cavity 211, therefore, the air volume of the debris discharging airflow can be increased through the at least one air guide portion 214, due to the different positions of the at least one air guide portion 214 and the air inlet 212, and the debris discharging airflow can pass through the at least one air guide portion 214 and the air inlet 212 in different directions, and the debris discharging airflow can pass through the at least one air guide portion and the air inlet in different directions, which can increase the airflow at different positions inside the debris bin, and is beneficial to promote the residual debris in the inner cavity 211 to be discharged through the debris outlet 213, thereby improving the debris evacuation efficiency of the debris bin assembly 20 and solving the problem of more debris remaining in the debris bin.

It can be understood that the cleaning robot 100 can be any one of a sweeping robot, an integrated sweeping and mopping robot, a mopping robot or a washing floor robot. In other embodiment, the cleaning robot 100 may not be limited to the above examples.

In the embodiment, the cleaning robot 100 is an integrated sweeping and mopping robot. The robot body 10 is a main body of the cleaning robot 100, and the robot body 10 can be in any shape such as a circle, a rectangle, or a D shape, which is not limited herein.

In an optional embodiment, the robot body 10 may also be of other design structures. For example, the robot body 10 is an integrally formed structure, and a left and right separated structure. The embodiment of the present application does not limit the material, shape, and structure of the robot body.

The robot body 10 may include a chassis 11 and an upper cover assembly 12. The upper cover assembly 12 is detachably mounted on the chassis 11 to protect various functional components inside the cleaning robot 100 from strongly impacting or damaging from accidentally dripping of spilled liquids during use; the chassis 11 and/or the upper cover assembly 12 are used to carry and support various functional components. The surface of the upper cover assembly 12 facing away from the chassis 11 forms an appearance surface, which can improve the overall appearance of the cleaning robot 100, and buttons can be provided on the appearance surface to facilitate the user to operate the cleaning robot 100 through the buttons. A mounting cavity is formed between the chassis 11 and the upper cover assembly 12, and the mounting cavity is used to provide an arrangement space for the internal components of the cleaning robot 100. The cleaning robot 100 can arrange a vacuum pump, a circuit board, a ground detection sensor, a collision detection sensor, and a wall sensor in the mounting cavity.

The cleaning robot 100 includes a traveling mechanism 13 mounted on the chassis 11. The traveling mechanism 13 includes two traveling wheels, at least one universal wheel, and a motor for driving the wheels to rotate. The two traveling wheels and the at least one universal wheel at least partially protrudes from the bottom portion 216 of the chassis 11. For example, under the action of the weight of the cleaning robot 100, the two traveling wheels can be partially hidden in the chassis 11. In an optional embodiment, the traveling mechanism 13 may further include any one of a triangular crawler wheel, a Mecanum wheel, and the like. The traveling mechanism 13 may also not include the at least one universal wheel.

The cleaning robot 100 may include at least one middle sweeping brush 14, and the at least one middle sweeping brush 14 may be arranged in a receiving groove provided at the bottom portion of the chassis 11, and a dust suction port is provided in the receiving groove, and the dust suction port is in communication with the debris bin assembly 20 and the dust suction fan, so that when the middle sweeping brush 14 rotates, dust and debris on the ground are stirred up, and the dust and debris are sucked into the debris bin assembly 20 from the dust suction port by using the suction force generated by the dust suction fan.

The cleaning robot 100 can be designed to plan a path on the ground autonomously, or the cleaning robot 100 can be designed to move on the ground in response to remote control commands. The cleaning robot 100 can navigate through one or a combination of gyroscopes, accelerometers, cameras, GPS positioning, and/or laser radar, and so on, for example, the cleaning robot 100 can be provided with the laser radar protruding from the top surface, the surrounding environment is scanned by the laser radar to collect obstacle data, and an environment map is established based on the obstacle data, the real-time positioning can be performed according to the environment map, which is convenient for planning cleaning paths.

In the embodiment, the debris bin assembly 20 is detachably mounted on the robot body 10. The debris bin assembly 20 and the robot body 10 can be assembled in various forms. For example, in some embodiments, the chassis 11 of the robot body 10 is provided with a mounting groove on the peripheral side, and the debris bin housing 21 of the debris bin assembly 20 is detachably mounted in the mounting groove, the debris bin housing 21 can form the debris outlet 213 in the bottom portion 216 or the peripheral side, the debris bin housing 21 can be separately mounted in the mounting groove of the chassis 11, the debris bin housing 21 can also be assembled with the water tank and then mounted in the mounting groove of the chassis 11. Alternatively, in another embodiment, the upper cover assembly 12 of the robot body 10 is provided with a mounting groove, and the debris bin housing 21 of the debris bin assembly 20 is detachably mounted in the mounting groove, and the debris outlet 213 is formed at the bottom portion 216 of the debris bin housing 21; the debris bin housing 21 can be separately mounted in the mounting groove of the upper cover assembly 12, and the debris bin housing 21 can also be assembled with the water tank as a whole and then mounted in the mounting groove of the upper cover assembly 12.

The air inlet 212 of the debris bin housing 21 is in communication with the dust suction port on the chassis 11. The debris bin housing 21 is further provided with an air outlet 219 in communication with the inner cavity 211, and the debris bin housing 21 is in communication with the dust suction fan through the air outlet 219. The debris bin assembly 20 further includes a filter 40, and the filter 40 is connected to the debris bin housing 21. The filter 40 is used to block the debris particles in the airflow from passing through the air outlet 219, so as to trap the debris in the inner cavity 211 of the debris bin housing 21. The filter 40 may be HEPA, sponge or other types of filter media.

Referring to FIG. 1, FIG. 4, FIG. 10 and FIG. 11, the dust suction airflow can pass through the air inlet 212 and the debris outlet 213, and after the external cleaning base station 200 is docked with the cleaning robot 100, the cleaning base station 200 can generate a suction negative pressure at the debris outlet 213 by a fan, and under the action of the negative pressure, the external air can form the dust suction airflow and pass through the air inlet 212 and the debris outlet 213 in turn. The air drives the debris to be discharged through the debris outlet 213 under the action of the suction negative pressure, so that the cleaning base station 200 can recover the debris stored in the debris bin housing 21.

Figure 10:
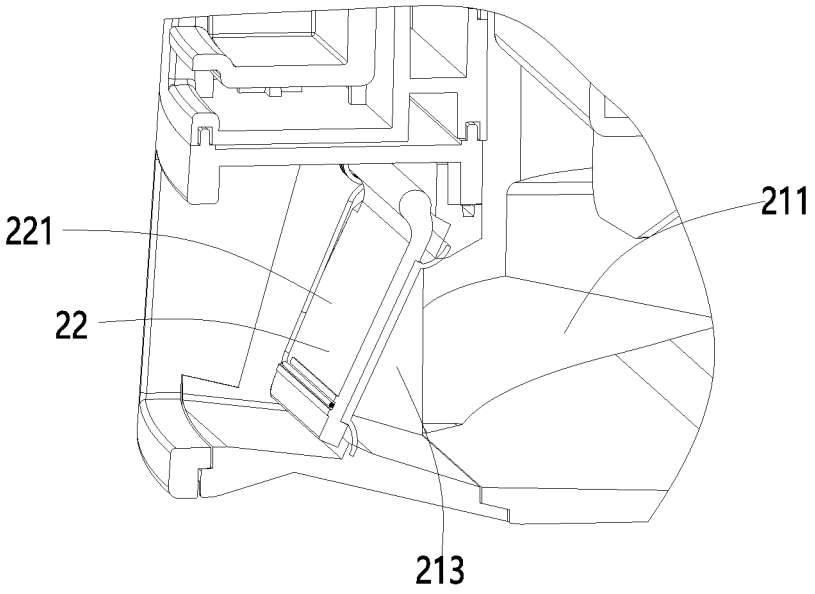
FIG. 10 is a schematic view of a partial cross-sectional structure of a debris bin assembly provided by an embodiment of the present application.

Referring to FIG. 10, the debris discharge valve 22 includes a cover member 221 and an elastic member. The cover member 221 is connected to the debris bin housing 21, and the cover member 221 can move relative to the debris bin housing 21 to a position where covers or opens the debris outlet 213. The cover member 221 can move relative to the debris bin housing 21 to a position where the debris outlet 213 is opened under the external suction effect, and after the suction effect is withdrawn, the cover member 221 is moved to a position where the debris outlet 213 is covered under the elastic recovery action of the elastic member or the action of its own elasticity. When the cover member 221 moves to the position where the debris outlet 213 is covered, the debris outlet 213 is in a closed state, and the cleaning robot 100 can normally clean the debris on the ground, and suck the debris into the debris bin housing 21 by suction force; when the cover member 221 moves to the position where the debris outlet 213 is opened, the debris outlet 213 is in an open state, and the cleaning base station 200 can evacuate the debris from box housing 21 through the debris outlet 213. In other embodiments, the cover member 221 can also move relative to the debris bin housing 21 under the driving of a driving device. Alternatively, the cover member 221 may be an elastic material (eg, rubber or silicone), and the cover member 221 may automatically cover the debris outlet 213 under the action of its own elasticity, thereby saving additional elastic members.

The cover member 221 may be any one of a plastic cover plate, a metal cover plate, a rubber cover plate, or a silicone cover plate.

Referring to FIG. 1 to FIG. 4, and FIG. 7, in the embodiment, the debris bin housing 21 includes a top portion 215, a bottom portion 216 disposed opposite to the top portion 215, and a side shell 217 connected between the top portion 215 and the bottom portion 216. The top portion 215, the bottom portion 216, and the side shell 217 are surrounded to form the inner cavity 211, the side shell 217 is provided with the air inlet 212 and the debris outlet 213, at least one of the top portion 215, the bottom portion 216 and the side shell 217 is provided with the air guide portion 214.

The top portion 215 is a top shell structure portion of the debris bin housing 21, and the bottom portion 216 is a bottom shell structure portion of the debris bin housing 21. A gap is provided between the top portion 215 and the bottom portion 216. The side shell 217 is enclosed on the peripheral sides of the top portion 215 and the bottom portion 216, so that the side shell 217, the top portion 215 and the bottom portion 216 are enclosed to form the inner cavity 211.

The top portion 215 of the debris bin housing 21 is provided therein with an air outlet channel 218. The air outlet channel 218 and the inner cavity 211 are arranged in sequence in the height direction of the debris bin housing 21, the opposite direction of the top portion 215 and the bottom portion 216 is the height direction of the debris bin housing 21. The air outlet channel 218 is in communication between the inner cavity 211 and the air outlet 219.

In the embodiment, the filter 40 can be mounted in the air outlet channel 218 inside the debris bin housing 21, and the top portion 215 includes a top shell body 41 and a movable cover plate 42, and the top shell body 41 is covered on the side of the side shell 217 away from the bottom portion 216. The upper surface of the top shell body 41 away from the inner cavity 211 is provided with a groove 43, and the movable cover plate 42 is rotatably connected to the top shell body 41 to cover or open the groove 43. The groove 43 forms a part of the air outlet channel 218. The filter 40 is detachably mounted in the groove 43, and the filter 40 can be removed and replaced by opening the movable cover plate 42. In an embodiment, the bottom portion 216 of the groove 43 is provided with a hollow structure, so that the air outlet channel 218 can be arranged in pneumatic communication with the inner cavity 211 through the hollow structure, and the filter 40 covers the hollow structure to filter debris. The filter 40 may include HEPA or sponge or other porous filter media. In other embodiments, the filter 40 can also be mounted at the air outlet 219.

In some embodiments, any one of the top portion 215, the bottom portion 216 and the side shell 217 is provided with the air guide portion 214, that is, the top portion 215 is provided with the air guide portion 214, or the bottom portion 216 is provided with the air guide portion 214, or the side shell 217 is provided with the air guide portion 214. The number of the air guide portions 214 can be adjusted according to actual needs, and the number of the air guide portions 214 can be one, two or more, which is not limited herein.

In other embodiments, any two of the top portion 215, the bottom portion 216 and the side shell 217 are provided with the air guide portion 214, that is, both the top portion 215 and the bottom portion 216 are provided with the air guide portion 214, or both the top portion 215 and the side shell 217 are provided with the air guide portion 214; or, both the bottom portion 216 and the side shell 217 are provided with the air guide portion 214. The number of the air guide portions 214 can be adjusted according to actual needs, and the number of the air guide portions 214 can be one, two or more, which is not limited herein.

In other embodiments, the top portion 215, the bottom portion 216 and the side shell 217 are all provided with the air guide portion 214. The number of the air guide portions 214 can be adjusted according to actual needs, and the number of the air guide portions 214 can be one, two or more, which is not limited herein.

It can be understood that the shape of the air guide portion 214 is not limited, and the air guide portion 214 can be in the shape of a rectangle, a triangle, a circle, an ellipse, or a special shape, etc. The size of the cross-sectional area of the air guide portion 214 is not limited. The air guide portion 214 is integrally provided with the debris bin housing 21, or the air guide portion 214 is a detachable structure on the debris bin housing 21.

Figure 4:
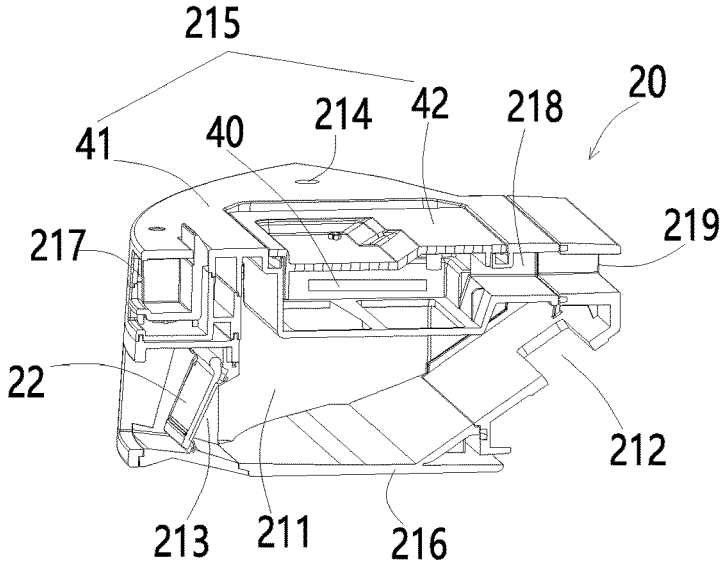
FIG. 4 is a second schematic view of a cross-sectional structure of a debris bin assembly provided by an embodiment of the present application.
Figure 5:
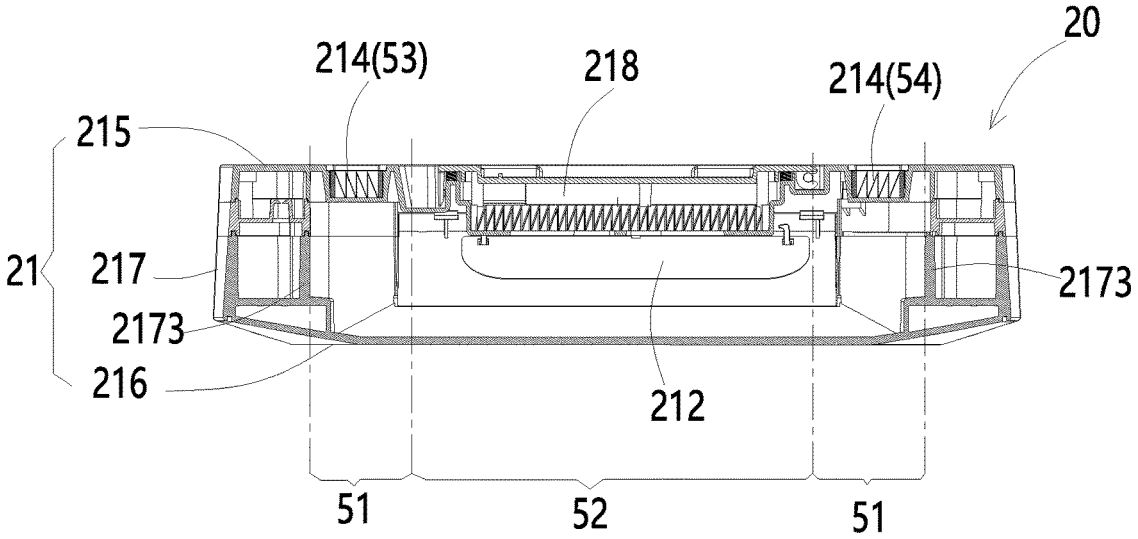
FIG. 5 is a third schematic view of a cross-sectional structure of a debris bin assembly provided by an embodiment of the present application.
Figure 6:
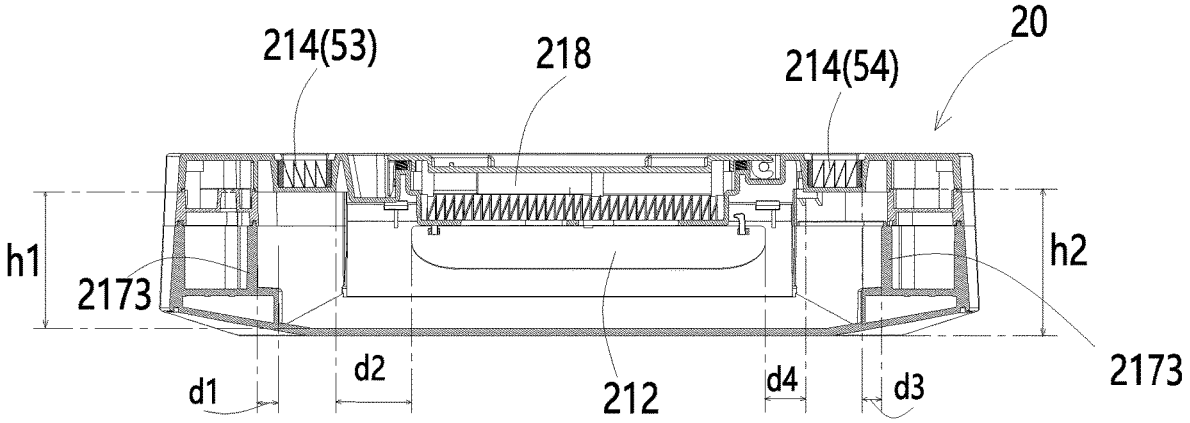
FIG. 6 is a fourth schematic view of a cross-sectional structure of a debris bin assembly provided by an embodiment of the present application.
Figure 7:
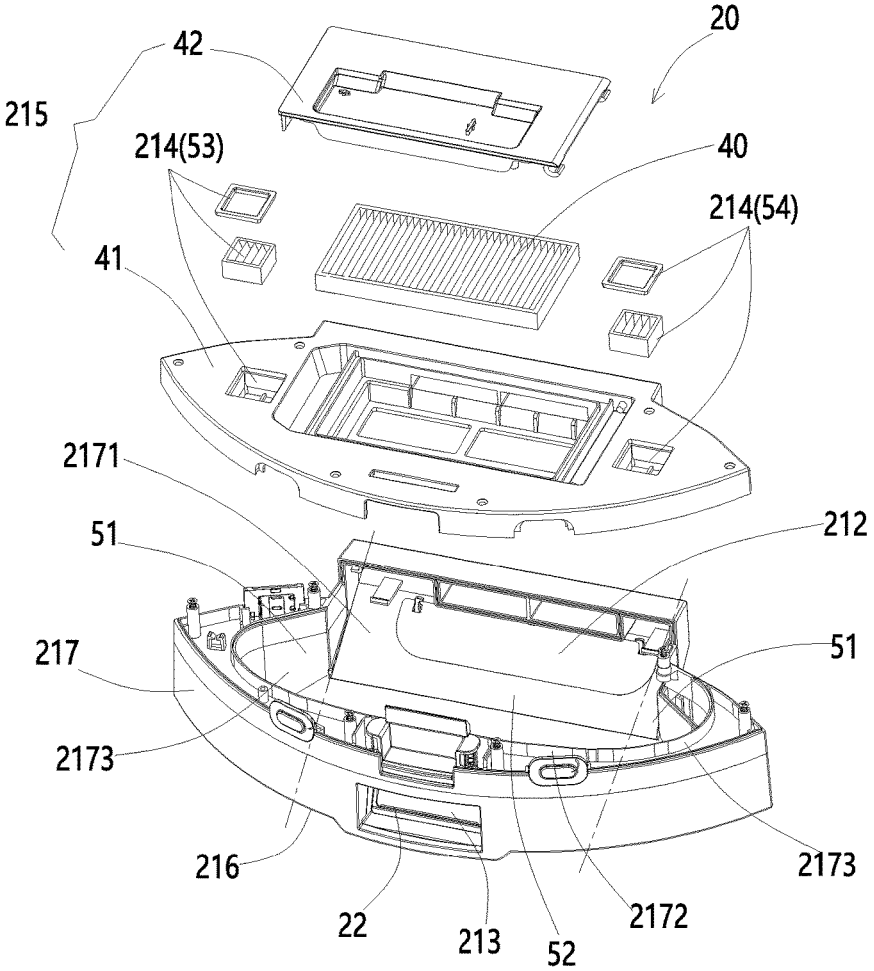
FIG. 7 is a first schematic view of an exploded structure of a debris bin assembly provided by an embodiment of the present application.

Referring to FIG. 4 and FIG. 5, in an embodiment, the air inlet direction of at least one of the air guide portions 214 is directed toward the bottom portion 216 of the debris bin housing 21, so that the debris discharging airflow introduced from the air guide portion 214 blows toward the bottom portion 216 of the debris bin housing 21, which is convenient to lift up the debris in the bottom portion 216 of the debris bin housing 21, so as to promote the debris (such as hair, large solid objects or wet debris, etc.) that is easily retained in the bottom portion 216 of the debris bin housing 21 flows to the debris outlet 213 following the debris discharging airflow. The air inlet direction of at least one air guide portion 214 disposed on the top portion 215 can be directed to the bottom portion 216 of the debris bin housing 21, or/and, the air inlet direction of at least one air guide portion 214 disposed on the side shell 217 can be directed to the bottom portion 216 of the debris bin housing 21, or/and, the air inlet direction of at least one air guide portion 214 disposed on the bottom portion 216 can be directed to the bottom portion 216 of the debris bin housing 21.

In an embodiment, the air inlet direction of the air guide portion 214 can be arranged perpendicular to the plane where the bottom portion 216 of the debris bin housing 21 is located, or the air inlet direction of the air guide portion 214 can be arranged inclining to the plane where the bottom portion 216 of the debris bin housing 21 is located.

Referring to FIG. 4 to FIG. 7, in an embodiment, the bottom portion 216 is provided with two side regions 51 disposed opposite to each other and a middle region 52 located between the two side regions 51, and the air inlet 212 of the side shell 217 is arranged corresponding to the middle region 52, the debris bin housing 21 is provided with a first air guide portion 53 and a second air guide portion 54, and the first air guide portion 53 and the second air guide portion 54 are respectively provided corresponding to the two side regions 51, so that the air inlet directions of the first air guide portion 53 and the second air guide portion 54 are directed to the two side regions 51 respectively.

In an embodiment, the debris bin housing 21 has a largest width in the direction from the left side to the right side, the two side regions 51 are adjacent to the left side and the right side of the debris bin housing 21 respectively, and the middle region 52 is approximately located at the middle position of the debris bin housing 21. The dust out airflows introduced from the first air guide portion 53 and the second air guide portion 54 are used to flow to the two side regions 51 respectively, so as to drive the debris in the two side regions 51 to flow to the middle region 52, and then under the action of the vacuum suction at the debris outlet 213 to be discharged from the debris outlet 213, so that the residual debris in the side regions 51 can be effectively reduced, therefore the debris evacuation efficiency of the debris bin is improved, and the user does not need to manually operate the debris bin to dump out the residual debris. In other embodiments, the top portion 215 can also be provided with one air guide portion 214 or more than two air guide portions 214. For example, the number of the first air guide portion 53 can be one or two or more, the number of the second air guide portion 54 can be one or two or more.

Referring to FIG. 4 to FIG. 7, in an embodiment, the side shell 217 is provided with a first side wall 2171 and a second side wall 2172 arranged opposite to the first side wall 2171, and two guide side walls 2173 arranged opposite to each other. The air inlet 212 is arranged penetrating the first side wall 2171, the debris outlet 213 is arranged penetrating the second side wall 2172, and the two guide side walls 2173 are respectively recessed toward the left and right sides of the debris bin assembly 20 to form the two side regions 51, and the two guide side walls 2173 are configured to guide airflow to the debris outlet 213.

In the embodiment, the two guide side walls 2173 are respectively recessed toward the left and right sides of the debris bin assembly 20 to form the two side regions 51, so that the debris bin housing 21 has a larger volume to accommodate debris. The two guide side walls 2173 are generally concave curved surfaces, and the distance between the two guide side walls 2173 is narrowed in the direction close to the debris outlet 213. The two guide side walls 2173 are respectively adjacent to the left and right sides of the debris outlet 213, and the first air guide portion 53 and the second air guide portion 54 are respectively adjacent to the two guide side walls 2173, the airflows guided from the first air guide portion 53 and the second air guide portion 54 is directed to the debris outlet 213 in a concentrated manner, thereby the debris concentrated in the two side regions 51 is driven to be directed to the debris outlet 213, to improve debris evacuation efficiency. In other embodiments, the shapes of the two guide side walls 2173 are not limited to a concave curved surface, and those skilled in the art can set the two guide side walls 2173 to other shapes, such as inclined surfaces, according to actual needs.

The two guide side walls 2173 include a first guide side wall 2173 adjacent to the first air guide portion 53 and a second guide side wall 2173 adjacent to the second air guide portion 54. The first guide side wall 2173 and the second guide side wall 2173 are adjacent to the left and right sides of the debris outlet 213, respectively. The relative direction of the first guide side wall 2173 and the second guide side wall 2173 is defined as the width direction of the debris bin housing 21.

The distance between the air guide portion 214 and the bottom portion 216 is ranged from 40 mm to 50 mm.

The minimum distance d1 between the first air guide portion 53 and the first guide side wall 2173 in the width direction of the debris bin housing 21 is ranged from 0 mm to 10 mm, and the minimum distance d2 between the first air guide portion 53 and the air inlet 212 in the width direction of the debris bin housing 21 is ranged from 20 mm to 30 mm. The distance h1 between the first air guide portion 53 and the bottom portion 216 is ranged from 40 mm to 50 mm. The inventor creative designs the structure of the first air guide portion 53 and the position size of the first air guide portion 53, so that the height of the starting position, the impact direction and the range of the introduction area of the debris discharging airflow introduced by the first air guide portion 53 can meet the requirements of completely guiding the debris in the side regions 51 to the middle region 52 and then discharge the debris to the debris outlet 213.

The minimum distance d2 between the second air guide portion 54 and the second guide side wall 2173 in the width direction of the debris bin housing 21 is ranged from 0 mm to 10 mm, and the minimum distance d4 between the second air guide portion 54 and the air inlet 212 in the width direction of the debris bin housing 21 is ranged from 20 mm to 30 mm. The distance h2 between the second air guide portion 54 and the bottom portion 216 is ranged from 40 mm to 50 mm. The inventor creative designs the structure of the second air guide portion 54 and the position size of the second air guide portion 54, so that the height of the starting position, the impact direction and the range of the introduction area of the debris discharging airflow introduced by the second air guide portion 54 can meet the requirements of completely guiding the debris in the side regions 51 to the middle region 52 and then discharge the debris to the debris outlet 213.

Referring to FIG. 4 to FIG. 7, in an embodiment, the debris outlet 213 and the air inlet 212 are respectively located on opposite sides of the side shell 217, and the connecting line direction defined between the debris outlet 213 and the air inlet 212 is arranged through the middle region 52. In the embodiment, the debris outlet 213 and the air inlet 212 are respectively located on the front and rear sides of the debris bin housing 21. In other embodiments, the debris outlet 213 is generally located on the left or right side of the debris bin housing 21, or the debris outlet 213 is located on the bottom portion 216 of the debris bin housing 21.

Referring to FIG. 4 to FIG. 7, in an embodiment, the top portion 215 is provided with an air outlet channel 218 in communication with the inner cavity 211 and an air outlet 219 in communication with the air outlet channel 218, and the debris bin assembly 20 is provided with a filter 40 located in the air outlet channel 218 to filter the solid particles entering the air outlet channel 218 from the inner cavity 211 through the filter 40, and the air outlet 219 is used to be arranged in communication with the air suction channel of the cleaning robot 100, the air inlet 212 is inclined toward the position where the filter 40 is located, the top portion 215 is provided with the air guide portion 214, and the air guide portion 214 is located on one side of the filter 40 and is staggered from the air inlet direction of air inlet 212.

In the embodiment, the top portion 215 includes a top shell body 41 and a movable cover plate 42, and the top shell body 41 is covered on the side of the side shell 217 away from the bottom portion 216. The upper surface of the top shell body 41 away from the inner cavity 211 is provided with a groove, and the movable cover plate 42 is rotatably connected to the top shell body 41 to cover or open the groove 43. The groove 43 forms a part of the air outlet channel 218. The filter 40 is detachably mounted in the groove 43, and the filter 40 can be removed and replaced by opening the movable cover plate 42. In an embodiment, the bottom portion 216 of the groove 43 is provided with a hollow structure, so that the air outlet channel 218 can be arranged in pneumatic communication with the inner cavity 211 through the hollow structure, and the filter 40 covers the hollow structure to filter debris.

The number of the air guide portion 214 can be one, two or more, which is not limited herein. In the embodiment, the top portion 215 is provided with a first air guide portion 53 and a second air guide portion 54 opposite to the first air guide portion 53. The first air guide portion 53 and the second air guide portion 54 are respectively disposed corresponding to the two side regions 51, that is, the first air guide portion 53 and the second air guide portion 54 are arranged respectively close to the left and right sides of the debris bin housing 21. The filter 40 is located between the first air guide portion 53 and the second air guide portion 54, and the filter 40 is disposed corresponding to the middle region 52. The air inlet direction of the air inlet 212 is arranged through the middle region 52, so that the air inlet direction of the air inlet 212 is staggered from both of the first air guide portion 53 and the second air guide portion 54, so that the positions of the first air guide portion 53, the second air guide portion 54 and the air inlet 212 are not the same. When the debris outlet 213 is subjected to a vacuum suction negative pressure, the air outlet airflow introduced from the air inlet 212 flows to the middle region 52, and the debris discharging airflow introduced from the first air guide portion 53 and the debris discharging airflow introduced from the second air guide portion 54 respectively flow to the two side regions 51, due that the positions of the at least one air guide portion 214 and the air inlet 212 are different, and the at least one air guide portion 214 and the air inlet 212 can guide the debris discharging airflow in different directions, which can increase airflow at the different positions inside the debris bin, which is beneficial to facilitate the discharge of the residual debris in the inner cavity 211 through the debris outlet 213, therefore the debris evacuation efficiency of the debris bin assembly 20 is improved, and the problem of more debris remaining in the debris bin is solved. In other embodiments, the number of the air guide portion 214 can also be one or more than two.

Referring to FIG. 4 to FIG. 8, in some embodiments, the air guide portion 214 includes an air guide cavity 2141 and a noise reduction assembly 2142, the air guide cavity 2141 is used to communicate the inner cavity 211 and the external air. The noise reduction assembly 2142 is disposed in the air guide cavity 2141, and the noise reduction assembly 2142 has a noise reduction effect on the airflow passing through the air guide cavity 2141. The noise reduction assembly 2142 includes muffler cotton 2143 and a muffler cotton cover 2144, the muffler cotton 2143 are accommodated in the air guide cavity 2141, and the muffler cotton cover 2144 covers the air inlet end of the air guide cavity 2141.

In another embodiment, the air guide portion 214 includes an air guide port and a movable valve. The movable valve is movably disposed at the air guide port to open or cover the air guide port, and the movable valve can open the air guide port in response to the vacuum suction negative pressure at the debris outlet 213, to introduce the debris discharging airflow through the air guide port, the movable valve covers the air guide port after the vacuum suction negative pressure at the debris outlet 213 is withdrawn. The structure of the movable valve is similar to the structure of the previous debris discharge valve, and reference can be made to the previous description, which is not repeated here. When the cleaning robot is working, the dust suction fan of the cleaning robot generates a first negative pressure in the inner cavity of the debris bin assembly, so as to suck in dust and debris through the air inlet, and the debris discharge valve and the movable valve are all closed; when the cleaning robot is docked with the cleaning base station, the dust suction fan of the cleaning base station generates a second negative pressure in the inner cavity of the debris bin assembly through the debris discharge port, so as to discharge the dust and debris through the debris discharge port, and both the debris discharge valve and the movable valve are in response to the second negative pressure to be in a closed state. Similarly, the noise reduction assembly 2142 can be arranged to reduce the noise of the debris discharging airflow passing through the air guide port, so as to reduce noise.

In another embodiment, the air guide portion 214 includes a plurality of ventilation micro-holes, and the plurality of ventilation micro-holes can function to communicate the inner cavity 211 and the external air, and when the debris outlet 213 is applied to the vacuum suction negative pressure, the plurality of ventilation micro-holes can also introduce the debris discharging airflow to the inner cavity 211. Similarly, the noise reduction assembly 2142 can be arranged to reduce the noise of the debris discharging airflow passing through the ventilation micro-holes, so as to reduce noise.

Figure 8:
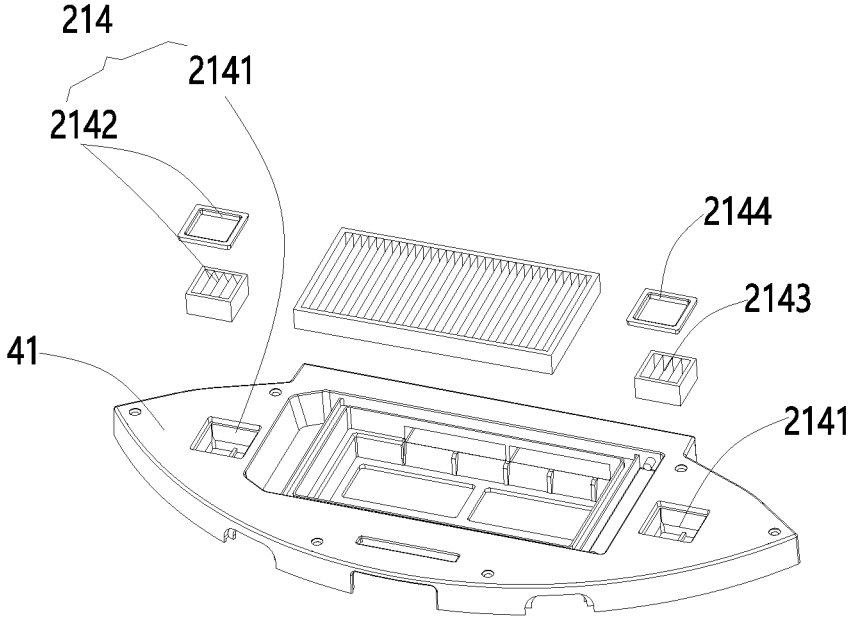
FIG. 8 is a second schematic view of an exploded structure of the debris bin assembly provided by an embodiment of the present application.
Figure 9:
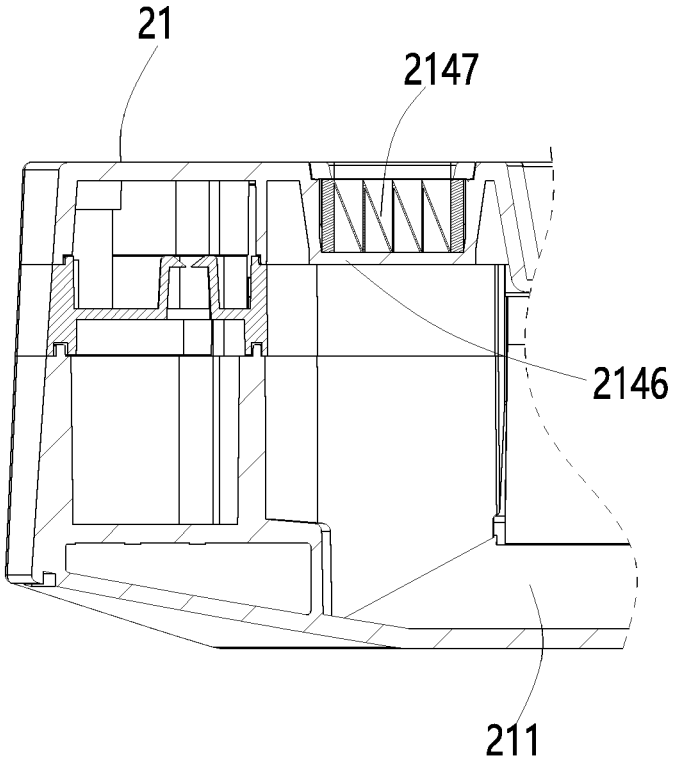
FIG. 9 is a schematic view of an exploded structure of an air guide portion of a debris bin assembly provided in an embodiment of the present application.

Referring to FIG. 8 and FIG. 9, the air guide portion 214 is positioned at the top portion 215 and extends toward the bottom portion 216 to form a protruding portion. The distance between the protruding end of the air guide portion 214 and the bottom portion 216 is ranged from 40 mm to 50 mm. The air guide portion 214 is provided with an air guide channel 2147, and the air guide channel 2147 extends outward from the protruding end of the protruding portion 2146 to penetrate the outer wall of the debris bin housing 21, the air guide channel 2147 is in a shape of a horn, and the cross-sectional area of the air guide channel 2147 gradually decreases in the extending direction near the protruding end.

In the embodiment, the debris bin housing 21 is provided with a protruding portion 2146 and an air guide channel 2147 penetrating the protruding portion 2146, the protruding portion 2146 is protrudingly disposed on the inner wall of the inner cavity 211, and the air guide channel 2147 extends outward from the protruding end of the protruding portion 2146 to penetrate the outer wall of the debris bin housing 21, and the air guide channel 2147 forms the air guide cavity 2141. In the embodiment, the protruding portion 2146 extends from the top portion 215 toward the bottom portion 216, and the distance between the protruding end of the protruding portion 2146 and the bottom portion 216 is ranged from 40 mm to 50 mm, so that the protruding portion 2146 is relatively close to the bottom portion 216, and the protruding portion 2146 increases the length of the air guide channel 2147, so that the air guide channel 2147 has a sufficient length to guide the debris discharging airflow, which is convenient for guiding the debris discharging airflow oriented to the bottom portion 216 of the debris bin housing 21, it is convenient to lift up the debris in the bottom portion 216 of the debris bin housing 21, so as to promote the debris (such as hair, large particle solid objects or wet debris, etc.) that is easily retained in the bottom portion 216 of the debris bin housing 21 to follow the debris discharging airflow to the debris outlet 213.

Figure 2:
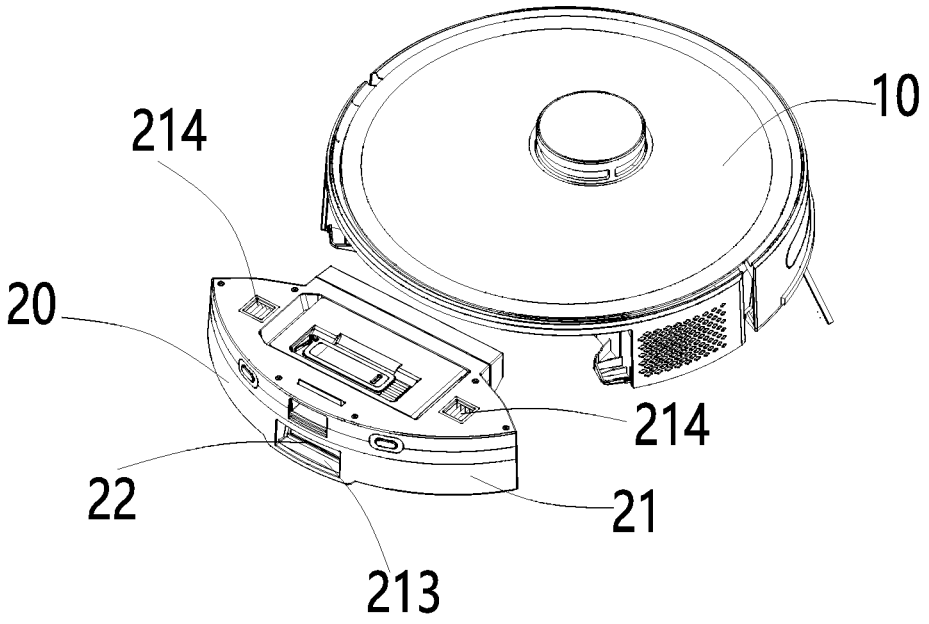
FIG. 2 is a schematic view of an exploded structure of a robot body and a debris bin assembly of a cleaning robot provided by an embodiment of the present application.
Figure 3:
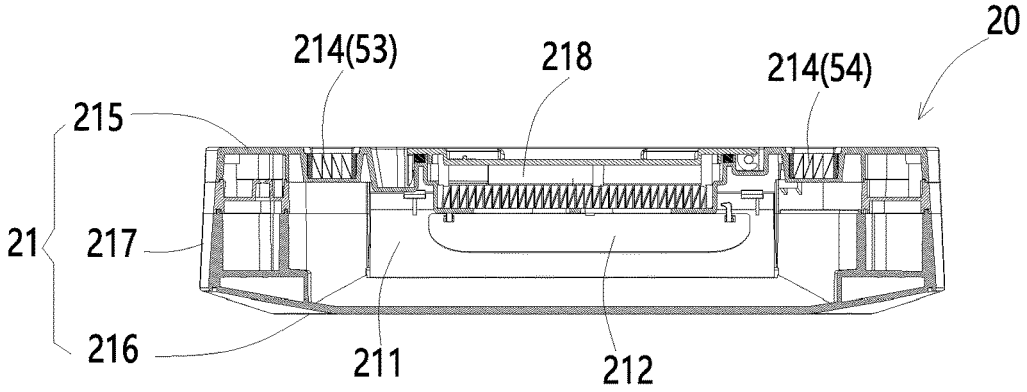
FIG. 3 is a first schematic view of a cross-sectional structure of a debris bin assembly provided by an embodiment of the present application.
Figure 11:
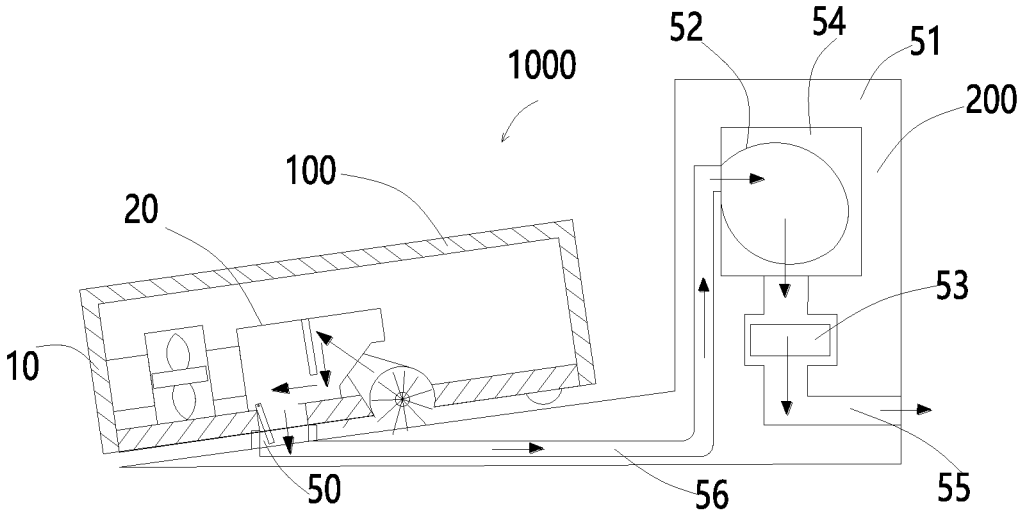
FIG. 11 is a schematic diagram of a longitudinal cross-sectional structure of a cleaning robot system provided by an embodiment of the present application.

Referring to FIG. 1, FIG. 2 and FIG. 11, an embodiment of the present application further provides a cleaning robot system 1000, where the cleaning robot system 1000 includes the cleaning robot 100 and the cleaning base station 200 described above. The cleaning base station 200 is provided with a debris collection port 50, and the debris collection port 50 is configured to align with the debris outlet 213 of the debris bin housing 21. The cleaning base station 200 evacuates the debris from the inner cavity 211 through the debris collection port 50 and the debris outlet 213.

The cleaning base station 200 includes a base station body 51, a debris collection container 52 and a suction device 53. The base station body 51 is provided with a dust collection cavity 54, a debris collection port 50, a debris inlet channel 56 and an air outlet channel 55. The debris collection port 50 is configured to align with the debris outlet 213 of the cleaning robot 100. One end of the debris inlet channel 30 is connected to the debris collection port 50 and the other end is connected to the dust collection cavity 54. One end of the air outlet channel 55 is connected to the dust collection cavity 54 and the other end is in communication with the atmosphere. The debris collection container 52 is detachably connected to the dust collection cavity 54 of the base station body 51, and the debris collection container 52 is mounted in the dust collection cavity 54 to communicate with the debris inlet channel 30 and communicate with the air outlet channel 55. The suction device 53 is fixed on the base station body 51, and the suction device 53 is used to drive the airflow to flow.

The suction device 53 can suck the air in the debris collection container 52 and the debris inlet channel 30 through the air outlet channel 55 to generate negative pressure in the debris collection container 52 and the debris inlet channel 30, so as to evacuate the debris from the debris bin assembly 20 into the debris collection container 52 under the action of negative pressure. In an embodiment, the debris collection container 52 can be a dust collection bag, a dust collection box or a dust collection tank.

It should be noted that the above embodiments are only used to illustrate the technical solutions of the present application, but not to limit herein; under the idea of the present application, the technical features in the above embodiments or different embodiments can also be combined, The steps may be carried out in any order, and there are many other variations of the different aspects of the present application as described above, for brevity, they are not provided in the details; although the present application has been described in detail with reference to the foregoing embodiments, those skilled in the art should understand that: it is still possible to modify the technical solutions described in the foregoing embodiments, or perform equivalent replacements to some of the technical features; and these modification or replacement does not make the essence of the corresponding technical solution deviate from the scope of the technical solutions of the embodiments of the present application.

What is claimed is:

1. A debris bin assembly, configured for use with a cleaning robot, and comprising:

a debris bin housing, comprising:

an inner cavity, an air inlet disposed in communication with the inner cavity and configured for being in communication with a debris inlet channel of the cleaning robot, a debris outlet disposed in communication with the inner cavity, and at least one air guide portion, disposed in communication with the inner cavity; and a debris discharge valve disposed at the debris outlet and configured to open the debris outlet to evacuate debris from the inner cavity in response to a vacuum negative pressure, and to close the debris outlet after the vacuum negative pressure is withdrawn; wherein the at least one air guide portion is configured for being in communication with an external air and configured to guide a debris discharging airflow into the inner cavity in response to the vacuum negative pressure in the debris outlet;

wherein the air guide portion comprises an air guide cavity and a noise reduction assembly, and the air guide cavity is configured for being in communication with the inner cavity and the external air, and the noise reduction assembly is arranged in the air guide cavity.

2. The debris bin assembly according to claim 1, wherein the debris bin housing comprises a top portion, a bottom portion disposed opposite to the top portion, and a side shell connected between the top portion and the bottom portion; the top portion, the bottom portion, and the side shell are enclosed to form the inner cavity, the side shell is provided with the air inlet and the debris outlet, and at least one of the top portion, the bottom portion, and the side shell is provided with the at least one air guide portion.

3. The debris bin assembly according to claim 2, wherein an air inlet direction of the at least one air guide portion is directed to the bottom portion of the debris bin housing.

4. The debris bin assembly according to claim 2, wherein the bottom portion is provided with two side regions arranged opposite to each other, and a middle region located between the two side regions, the air inlet of the side shell is arranged corresponding to the middle region, the at least one air guide portion comprises a first air guide portion and a second air guide portion, and the first air guide portion and the second air guide portion are respectively arranged corresponding to the two side regions, such that air inlet directions of the first air guide portion and the second air guide portion are respectively directed to the two side regions.

5. The debris bin assembly according to claim 4, wherein the debris outlet and the air inlet are respectively located on opposite sides of the side shell, and a connecting line direction defined between the debris outlet and the air inlet is arranged passing through the middle region.

6. The debris bin assembly according to claim 4, wherein the side shell is provided with a first side wall, a second side wall arranged opposite to the first side wall, and two guide side walls arranged opposite to each other; the air inlet is arranged penetrating the first side wall, the debris outlet is arranged penetrating the second side wall, and the two guide side walls are respectively recessed towards a left side and a right side of the debris bin assembly to form the two side regions, the two guide side walls are configured to guide airflows to the debris outlet.

7. The debris bin assembly according to claim 2, wherein the top portion is provided with an air outlet channel in communication with the inner cavity and an air outlet in communication with the air outlet channel, and the debris bin assembly is provided in a filter assembly arranged in the air outlet channel to filter solid particles entering the air outlet channel from the inner cavity through the filter assembly, and the air outlet is configured for being in communication with an air suction channel of the cleaning robot, the air outlet is inclined toward a position of the filter assembly, the top portion is provided with the air guide portion, and the air guide portion is located on one side of the filter assembly and is arranged staggered from an air inlet direction of the air inlet.

8. The debris bin assembly according to claim 1, wherein the noise reduction assembly comprises muffler cotton and a muffler cotton cover, the muffler cotton is accommodated in the air guide cavity, and the muffler cotton cover covers an air inlet end of the air guide cavity.

9. The debris bin assembly according to claim 1, wherein the debris bin housing is provided with a protruding portion and an air guide channel penetrating the protruding portion, and the protruding portion is protrudingly arranged on an inner wall of the inner cavity, the air guide channel extends outward from a protruding end of the protruding portion to penetrate an outer wall of the debris bin housing, and the air guide channel forms the air guide cavity.

10. The debris bin assembly according to claim 2, wherein the air guide portion is positioned at the top portion and extends toward the bottom portion to form a protruding portion.

11. The debris bin assembly according to claim 10, wherein a distance between a protruding end of the air guide portion and the bottom portion is ranged from 40 mm to 50 mm.

12. The debris bin assembly according to claim 10, wherein the air guide portion is provided with an air guide channel, and the air guide channel extends outward from a protruding end of the protruding portion to penetrate an outer wall of the debris bin housing, the air guide channel is in a shape of a horn, and a cross-sectional area of the air guide channel gradually decreases in an extending direction close to the protruding end.

13. The debris bin assembly according to claim 2, wherein the air guide portion includes an air guide port and a movable valve, and the movable valve is movably disposed at the air guide port to open or cover the air guide port, and the movable valve can open the air guide port in response to the vacuum suction negative pressure at the debris outlet, and the movable valve covers the air guide port after the vacuum suction negative pressure at the debris outlet is withdrawn.

14. The debris bin assembly according to claim 2, wherein the side shell is provided with a first side wall, a second side wall disposed opposite to the first side wall, and two guide side walls disposed opposite to each other, the air inlet is arranged penetrating the first side wall, the debris outlet is arranged penetrating the second side wall, the two guide side walls are respectively recessed towards a left side and a right side of the debris bin assembly, the two guide side walls are configured for guiding an airflow to the debris outlet.

15. The debris bin assembly according to claim 14, wherein an opposite direction of the two guide side walls is defined as a width direction of the debris bin housing, the two guide side walls comprises a first guide side wall and a second guide side wall, the at least one air guide portion comprises a first air guide portion and a second air guide portion, the first air guide portion and the second air guide portion are respectively arranged adjacent to the first guide side wall and the second guide side wall.

16. The debris bin assembly according to claim 15, wherein a minimum distance between the first air guide portion and the first guide side wall in the width direction of the debris bin housing is ranged from 0 mm to 10 mm; a minimum distance between the first air guide portion and the air inlet in the width direction of the debris bin housing is ranged from 20 mm to 30 mm.

17. The debris bin assembly according to claim 16, wherein a minimum distance between the second air guide portion and the second guide side wall in the width direction of the debris bin housing is ranged from 0 mm to 10 mm; a minimum distance between the second air guide portion and the air inlet in the width direction of the debris bin housing is ranged from 20 mm to 30 mm.

18. A cleaning robot, comprising a robot body and a debris bin assembly, wherein the debris bin assembly comprises:

a debris bin housing, comprising:

an inner cavity, an air inlet disposed in communication with the inner cavity and configured for being in communication with a debris inlet channel of the cleaning robot, a debris outlet disposed in communication with the inner cavity, and at least one air guide portion, disposed in communication with the inner cavity; and a debris discharge valve disposed at the debris outlet and configured to open the debris outlet to evacuate debris from the inner cavity in response to a vacuum negative pressure, and to close the debris outlet after the vacuum negative pressure is withdrawn; wherein the at least one air guide portion is configured for being in communication with an external air and configured to guide a debris discharging airflow into the inner cavity in response to the vacuum negative pressure in the debris outlet;

wherein the debris bin assembly is detachably mounted on the robot body; and wherein the air guide portion comprises an air guide cavity and a noise reduction assembly, and the air guide cavity is configured for being in communication with the inner cavity and the external air, and the noise reduction assembly is arranged in the air guide cavity.

19. A debris bin assembly, applied to a cleaning robot, and comprising:

a debris bin housing, comprising:

an inner cavity, an air inlet disposed in communication with the inner cavity and configured for being in communication with a debris inlet channel of the cleaning robot, a debris outlet disposed in communication with the inner cavity, and at least one air guide portion, disposed in communication with the inner cavity; and a debris discharge valve disposed at the debris outlet and configured to open the debris outlet to evacuate debris from the inner cavity in response to a vacuum negative pressure, and to close the debris outlet after the vacuum negative pressure is withdrawn; wherein the at least one air guide portion is configured for being in communication with an external air and configured to guide a debris discharging airflow into the inner cavity in response to the vacuum negative pressure in the debris outlet;

wherein the debris bin housing comprises a top portion, a bottom portion disposed opposite to the top portion, and a side shell connected between the top portion and the bottom portion; the top portion, the bottom portion, and the side shell are enclosed to form the inner cavity, the side shell is provided with the air inlet and the debris outlet, and at least one of the top portion, the bottom portion, and the side shell is provided with the air guide portion;

wherein the air guide portion includes an air guide port and a movable valve, and the movable valve is movably disposed at the air guide port to open or cover the air guide port, and the movable valve can open the air guide port in response to the vacuum suction negative pressure at the debris outlet, and the movable valve covers the air guide port after the vacuum suction negative pressure at the debris outlet is withdrawn.

* * * * *